United States Patent [19]

Howard

[11] 4,300,761

[45] Nov. 17, 1981

[54] SPRING TYPE EXERCISING DEVICE

[76] Inventor: William E. Howard, 289 N. Quaker La., West Hartford, Conn. 06119

[21] Appl. No.: 194,079

[22] Filed: Oct. 6, 1980

[51] Int. Cl.[3] ..... A63B 21/00

[52] U.S. Cl. ..... 272/134; 272/145; 272/142; 272/73; 272/DIG. 4; 5/149

[58] Field of Search ..... 272/73, 136, 142, 144, 272/134, 116, 118, 93; 5/111, 114, 133, 149, 157

[56] References Cited

U.S. PATENT DOCUMENTS

| | | | |
|---|---|---|---|
| 2,219,219 | 10/1940 | Boger | 272/134 X |
| 2,632,645 | 3/1953 | Barkschat | 272/118 X |
| 2,788,528 | 4/1957 | Hansen | 5/149 X |

FOREIGN PATENT DOCUMENTS

| | | | |
|---|---|---|---|
| 70258 | 12/1969 | Fed. Rep. of Germany | 272/73 |

*Primary Examiner*—Richard C. Pinkham

*Assistant Examiner*—William R. Browne

*Attorney, Agent, or Firm*—Prutzman, Kalb, Chilton & Alix

[57] ABSTRACT

An exercising equipment unit is provided in which a cabinet of rectilinear form having the appearance of a conventional piece of furniture when not in use, has mounted therein an articulated body support platform having an inner section pivotally connected to the interior of the cabinet, a center bench section hingedly attached to the inner section, and an outer section hingedly connected to the center bench section. The platform sections are dimensioned to fit along the back top and front of the interior of the cabinet when in stored condition and may be extended to a horizontal position raised above the floor. The platform sections are narrower than the cabinet to provide space on either side for the installation of exercising equipment. A foot pedal assembly may be mounted on the inner end of the inner section of the body support platform.

6 Claims, 6 Drawing Figures

SPRING TYPE EXERCISING DEVICE

This invention relates to exercise equipment and is concerned, more particularly, with equipment for exercising the human body which is intended for use by an individual while indoors such as in a home or office.

In order for an average person having a limited amount of free time and a limited budget to enjoy good health and adequately maintain physical fitness, it is very advantageous to have excerise equipment installed at the home or office so that it is available for use whenever time permits without regard to weather conditions and without the need and expense for traveling and utilizing outside facilities. However, unless an extra room such as a separate recreation room or the like is available for such use, the installation in the home or office of conventional commercially available excerise equipment presents a very serious space problem and in addition materially detracts from the appearance and functioning of a room primarily intended for other purposes.

Accordingly, an aim of the invention is to provide exercise equipment of the type referred to which is constructed as a self-contained unit which can be folded up into compact form for storage so that a minimum amount of room is required to accommodate the equipment when it is not in use. Also included in this aim is the provision of such equipment which will have an attractive appearance when in stored condition so that it will enhance rather than detract from the decor of the room of a home or office in which it is used.

A further aim of the invention is to provide exercise equipment of the type referred to which is self-inclusive without need for additional accessories and requires no attachment to the floor or walls of the room in which it is used and which is readily movable in case it is desired to change its location.

Another aim is to provide such an exercise equipment unit which although being capable of compact storage will have a variety of exercising functions not limited to exercising only a few parts of the body thereby giving it a wide appeal and increasing the enjoyment resulting from its use.

Another aim is to provide an exercising equipment unit of the type referred to which is simple and easy to use and to convert from stored condition to operating condition and vice versa with a minimum of skill and instruction and with a minimum of effort.

An additional object is to provide such an exercising equipment unit which is rugged in construction and able to function effectively over a long period of time without need for repair and replacement and yet which can be fabricated and assembled and marketed at reasonable cost.

Other objectives will be in part obvious and in part pointed out in more detail hereinafter.

A better understanding of the invention will be obtained from the following description and the accompanying drawing of an illustrative application of the invention.

DESCRIPTION OF THE PREFERRED EMBODIMENT

Figure 1:
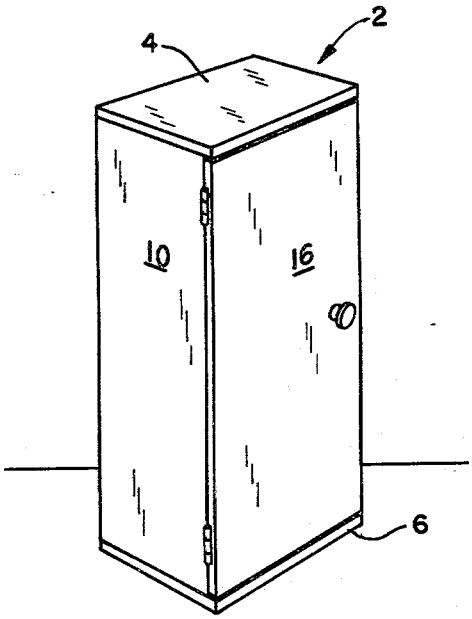
FIG. 1 is a perspective view of the exterior of the exercise equipment unit when in stored condition and not in use.

Referring to the drawings in detail, the exercise equipment unit of my invention is provided with an outer cabinet 2 of rectangular form as shown in perspective in FIG. 1, the cabinet 2 being comprised of a top 4, bottom 6, rear panel 8 and side panels 10 and 12. The front opening 14 extending the entire width and height of the cabinet 2 may be closed by the door 16 that is hingedly fastened at the front edge of the side panel 10.

Figure 2:
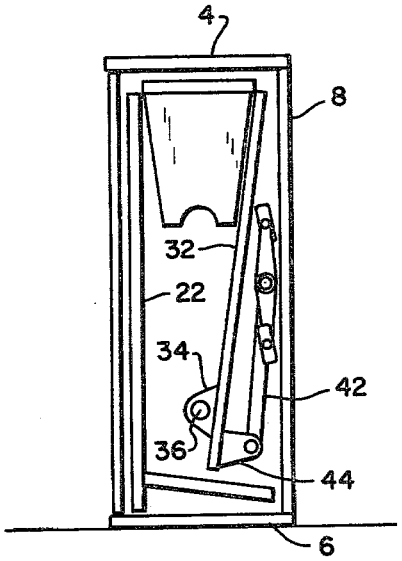
FIG. 2 is a side view of the unit with the side panel and rope pull devices removed and with the foot pedal assembly and body support platform shown in stored condition.
Figure 4:
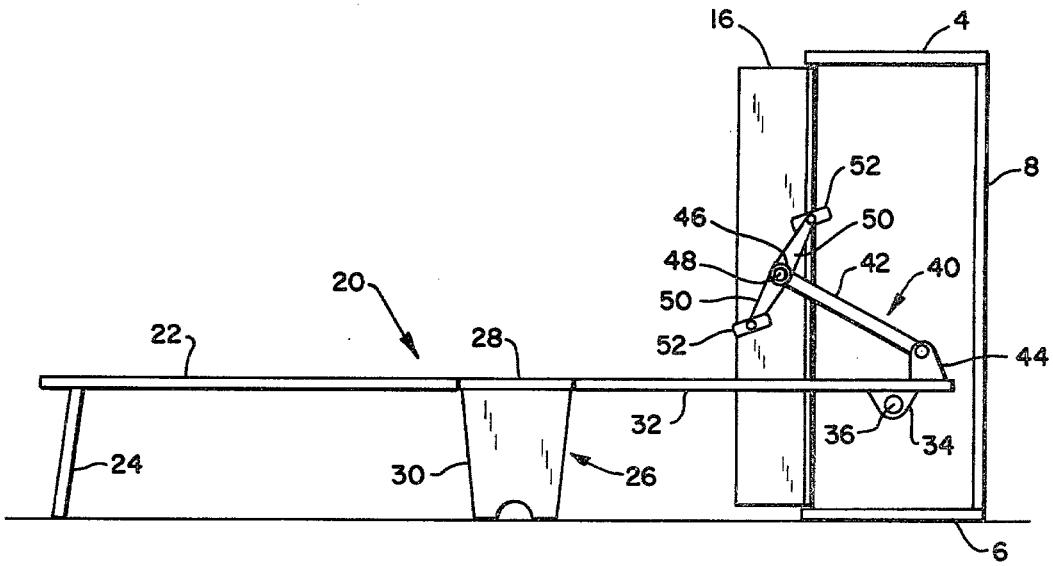
FIG. 4 is a view similar to that of FIG. 3, with the body support platform fully extended and the foot pedal assembly in operating position.

Located at the transverse center of the cabinet 2 is an articulated body support platform designated in its entirety by reference numeral 20 which can be folded into a stored condition within the cabinet 2 as shown in FIG. 2 of the drawing or may be extended outwardly to an operating position as shown in FIG. 4 of the drawing. The body support platform 20 comprises an outer section 22 in the form of a flat board having a depending supporting member or leg 24 at its outer end and being hingedly connected at its inner end to one edge of a central bench section 26 that has a narrow flat top 28 and depending side supports or legs 30. The other edge of the bench section 26 is hingedly connected to the inner support platform section 32 which at its inner end is provided with depending brackets 34 (one shown) journaled on the cross-bar 36 by means of which the inner end of the inner section is pivotally connected to the interior of the cabinet 2. The cross-bar 36 extends between and is supported by the side panels 10 and 12. The front to back width of the central bench section 26 is preferably made just slightly narrower than the top 4 of the cabinet 2 and the bench sections 22 and 23 are made long enough to position the top 28 of the bench section 26 closely adjacent to the top 4 of the cabinet as best shown in FIG. 2 of the drawings. In this way a maximum length for the extended support platform 20 can be obtained commensurate with the dimensions of the cabinet 2. As a specific example, in a preferred embodiment of the invention a support platform 20 having an extended length of six feet is housed within a cabinet 2 which is only thirty-eight inches high and thirteen inches deep.

Figure 3:
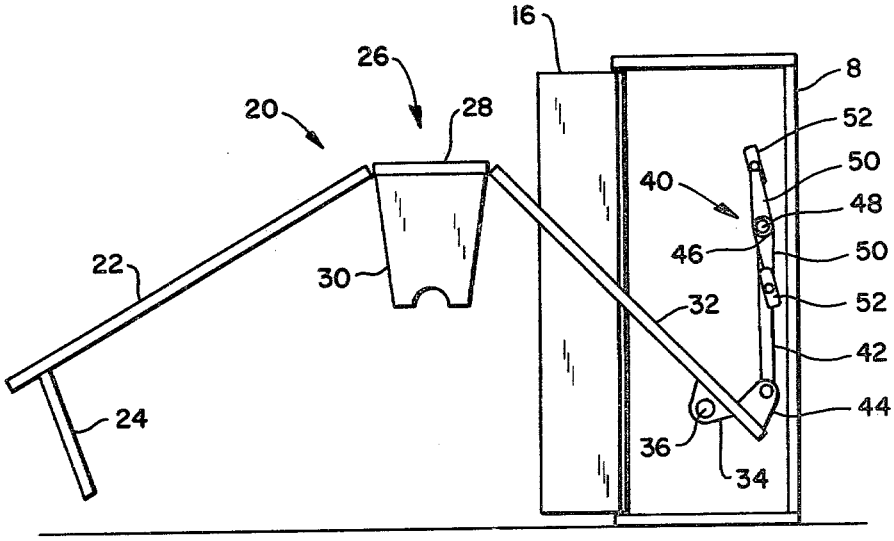
FIG. 3 is a view similar to that of FIG. 2 with the door of the cabinet open and the body support platform partially extended.
Figure 6:
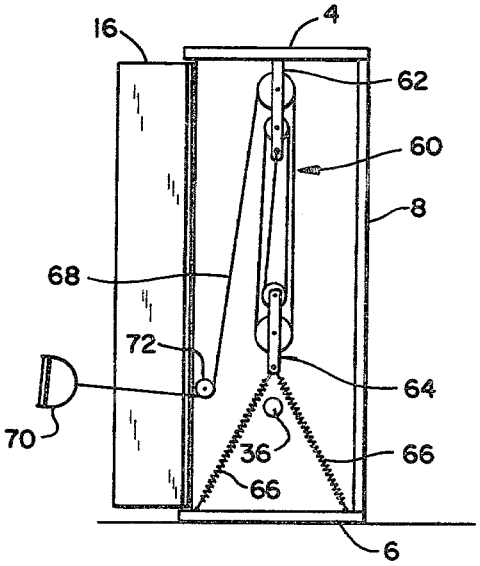
FIG. 6 is a side view of the cabinet with the door open and side panel removed to expose the rope pull device installed adjacent to the side panel.

As best shown in FIGs. 2, 3, and 6 of the drawings, a foot pedal assembly indicated generally by reference numeral 40 is pivotally supported on the inner end of the inner support platform section 32. The assembly comprises a supporting member 42 pivotally connected at one end to the brackets 44 (one shown) fastened on the inner end of platform section 32 and having a journal 46 at its free end for supporting a transverse shaft 48. On the opposite ends of shaft 48 are mounted diametrically opposite radially extending arms 50 rotatably supporting foot pedals 52 at their outer ends. The arrangement is generally similar to a foot-pedal assembly as commonly used on bicycles. When the exercise unit is in stored condition, the foot-pedal assembly is pivoted to the rear of the cabinet 2 as shown in FIG. 2 of the drawings, but when the foot pedals are to be operated, the supporting member 42 is pivoted to an angular outwardly extending position as shown in FIG. 4 of the drawings. A latch or the like (not shown) may be provided to hold the supporting member 42 in selected position. Because the foot pedal assembly 40 is mounted on the inner end of the platform 20, no strain is applied to the rear panel 8 when the assembly 40 is in use.

Figure 5:
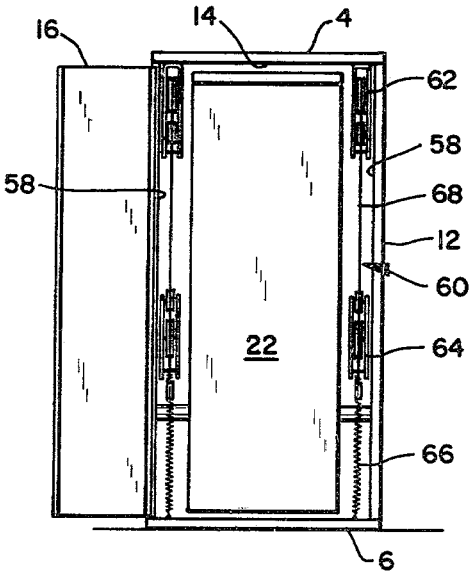
FIG. 5 is a front view of the cabinet with the door open and the body support platform in retracted position.

As best shown in FIG. 5 of the drawings, the body support platform 20 is made narrower than the width and front opening 14 of the cabinet 2 to provide side spaces indicated generally at 58 for accommodating additional exercising equipment which is the specific embodiment shown in the drawings comprises rope pull devices 60 described hereinafter in more detail. As a specific example, it has been found that in a preferred embodiment of the invention a platform width of twelve inches is ample for the comfort of the average user of the unit with the result that the width of the cabinet 2 can be reduced to about seventeen inches and this will still provide ample space for the housing of the rope pull devices 60 to be described.

Each of the rope pull devices 60 comprises a hoist consisting of an upper double sheave block 62 attached to the top 4 of the cabinet 2 and a lower double sheave block 64 attached by two springs 66 to the bottom 6 of the cabinet 2. A pull rope 68 having a hand grip 70 at its outer end is attached to the upper block 62 and then passes over the sheaves of the lower and upper blocks as shown in FIG. 6 of the drawing. If desired, the hand grips 70 may be of the squeeze type. A pulley 72 is secured to the inside of each of the side panels 10, 12 near the bottom thereof under which the ropes 68 are run as shown in FIG. 6 when the rope pull devices 60 are being used. As a result of the mechanical advantage of the arrangement of pulleys as described, the hand grips 70 and attached ends of the ropes 68 can be pulled outwardly by the exerciser a relatively long distance compared to the much smaller amount of movement imparted to the upper ends of the springs 66 by the lower sheave block 64. The springs 66 being mounted in tension provide the desired restraining force on the ropes when they are pulled outwardly by the operator and also serve to retract the ropes when they are released by the exerciser.

The operation and functioning of my exercise equipment unit will be apparent from the foregoing detailed description taken together with the following further explanation. As previously mentioned, when the exercise equipment unit is not in use, the operating parts are folded out of sight inside the cabinet 2 as shown in FIG. 2 and when the door 16 is closed as shown in FIG. 1 of the drawings, the cabinet 2 looks like a conventional piece of house or office furniture, particularly with respect to the preferred embodiment as described above having a height, width and depth of only thirty-eight, seventeen and thirteen inches respectively. When the unit is to be used, the door 16 is swung open and the outer section 22 of the support platform is pulled outwardly beginning as shown in FIG. 3 of the drawings and then being pulled out all the way to the fully extended position shown in FIG. 4 of the drawings. When fully extended, the platform 20 is supported at its outer end by the depending member 24, at its center by the legs of the bench section 36 and at its inner end by the cross-bar 36.

The platform 20 forms a convenient raised support upon whic the user can lie or sit to operate the exercising devices 40 and 60 or perform such other exercise as desired. In the preferred embodiment, the platform is elevated a convenient ten inches above the floor. If desired for additional comfort, a thin layer of padding (not shown) may be applied to the top surfaces of the platform 20 and also, if desired, a conventional strap (not shown) may be provided for holding down the feet of the user when it is desired to do sit-up exercises or the like. Upon completion of the exercising, the user can quickly and easily return the parts of the stored and closed portion shown in FIGS. 1 and 2 of the drawing whereupon the unit again resembles a conventional piece of furniture having its use and purpose concealed.

As will be apparent to persons skilled in the art, various modifications, adaptations and variations of the foregoing specific disclosure can be made without departing from the teachings of the present invention.

I claim:

1. An exercising equipment unit comprising a generally rectangular cabinet having a front opening, an articulated body support platform comprising a first section attached at one end by a pivotal connection to the interior of the cabinet at the bottom portion thereof, a center bench section hingedly attached at one edge to the other end of the first section and having floor engaging supports, and an outer section hingedly connected at one end to the other edge of the center bench section and having a depending supporting member at its free end, the lengths of the first and the outer sections being dimensioned so that the platform may be folded within the cabinet with the first and the outer sections extending upwardly and disposing the top of the center bench section closely adjacent to the top of the cabinet and the length of the center bench section between the said side edges thereof being dimensioned to dispose the hingedly connected ends of the first and the outer sections closely adjacent to the back and front of the cabinet, respectively, the height of the pivotal connection of the first section and of the center bench section and the length of the supporting member of the outer section being dimensioned so that the platform, when extended outwardly from the cabinet, is supported in a raised horizontal flat position, the platform being of less width than the cabinet with its side edges sufficiently spaced from the side edges of the cabinet to permit the installation of exercising devices therebetween.

2. An exercising equipment unit as defined in claim 1 wherein the front opening of the cabinet extends substantially the entire width of the cabinet and from top to bottom thereof, and door means is provided for closing the opening when the unit is not in use.

3. An exercising equipment unit as defined in claims 1 or 2 wherein the said pivotal connection of the first section of the support platform comprises a cross-bar extending between the sides of the cabinet on which the said one end of the section is pivotally supported.

4. An exercising equipment unit as defined in claims 1 or 2 wherein rope pull devices are mounted within the cabinet between the platform and the sides of the cabinet.

5. An exercising equipment unit as defined in claim 1 wherein a rotatable foot pedal assembly is mounted on said one end of the first section of the body support platform.

6. An exercising equipment unit as defined in claim 5 wherein the rotatable foot pedal assembly is pivotally connected to the said first section whereby the position of the assembly toward and away from the back of the cabinet may be varied.

* * * * *